US005495737A

United States Patent [19]

Graham

[11] Patent Number: 5,495,737

[45] Date of Patent: Mar. 5, 1996

[54] ELEVATED TEMPERATURE METAL FORMING LUBRICATION

[75] Inventor: Edgar E. Graham, Lyndhurst, Ohio

[73] Assignee: Cleveland State University, Cleveland, Ohio

[21] Appl. No.: 275,449

[22] Filed: Jul. 15, 1994

[51] Int. Cl.[6] ..... B21B 45/02; B21B 45/00

[52] U.S. Cl. ..... 72/42; 72/46; 252/29

[58] Field of Search ..... 72/42, 46; 252/29

[56] References Cited

U.S. PATENT DOCUMENTS

| | | | |
|---|---|---|---|
| 4,303,537 | 12/1981 | Laepple et al. | 72/42 |
| 4,612,127 | 9/1986 | Uematsu et al. | 72/42 |
| 4,869,764 | 9/1989 | Marwick | 72/42 |
| 4,913,927 | 4/1990 | Anderson | 72/42 |
| 5,139,876 | 8/1992 | Graham et al. | 428/420 |

*Primary Examiner*—Lowell A. Larson
*Assistant Examiner*—Rodney A. Butler
*Attorney, Agent, or Firm*—John F. McDevitt

[57] ABSTRACT

An improved method to lubricate a metal workpiece at elevated temperatures is described employing a novel polymer lubricant formed in situ. The novel lubricant is provided with a liquid mist of a lubricant preparation containing a vaporizable and polymerizable organic reactant in combination with graphite particulates being supplied to both workpiece and forming die at the elevated working temperatures.

15 Claims, 2 Drawing Sheets

ELEVATED TEMPERATURE METAL FORMING LUBRICATION

BACKGROUND OF THE INVENTION

This invention relates generally to an improved method for lubrication of metal workpieces being formed at elevated working temperatures of at least 250° C. and higher and more particularly to a novel lubricant combination for such method of metal forming which includes formation of a novel polymer lubricant in situ at the elevated working temperatures.

Various lubrication means are known whereby metal workpieces being formed at elevated temperatures with one or more die members, such as by forging or by extrusion, are provided with lubrication both prior to and during the metal forming operations. Both workpieces and die members are often heated to very elevated temperatures, particularly if ferrous metals are being formed, with the lubricant often being supplied in copious quantities to provide both lubrication and cooling of the die members. For example, U.S. Pat. No. 2,821,016 describes the hot forging of steel billets or slugs preheated at temperatures up to 2300° F. and thereafter formed with movable and fixed die members being maintained with the liquid lubricant below 1000° F. In doing so, the die members are flooded with a lubricating solution of colloidal graphite suspended in water containing a soluble oil. While such lubrication is reported to prevent "score+ marks on the forged product and die members, it has also been found that considerable cleaning of these articles is required to remove adherent carbon particles.

Other water-based lubricants have similarly been employed which are said to provide better lubrication means than achieved with "oil-base+ suspensions of graphite and still other particulates. For example, there is disclosed in U.S. Pat. No. 4,401,579 a lubricant composition employing fumaric acid salts as the primary lubricating and release agent for use in forging operations. As therein employed, such lubricant compositions can further include other suitable thickeners and polymethacrylates, polyvinyl alcohol, starch, gelatin, gum arabic and polysaccharides along with sufactants, wetting and dispersing agents. Suitable use of such lubrication means is further said to include other metal forming operations such as drawing, press forming, extrusion, wire drawing and other processes where workpiece temperatures reach at least about 800° F. In a reported test the die members were preheated to 500° F. with the die members being sprayed with the disclosed lubricant while low carbon steel billets heated to 2150° F. were being forged therein. A different lubricant composition is disclosed in U.S. Pat. No. 4,765,917 for use in elevated temperature metal forming operations. This water-based lubricant is said to comprise about one percent to about forty percent by weight of a polycarboxylic acid salt reaction product, such as trimellitic acid and an alkali metal or an alkaline earth metal hydroxide such that the pH of the composition is about 6.5 to about 10 along with about 0.1 percent to about 12 percent by weight of a water dispersible thickening agent, and the balance water. Said water-based lubricant is said to further optionally include extreme pressure additives, performance enhancers and biocidal agents. Representative extreme pressure additives are said to include phosphate esters while listed performance enhancers include ammonium phosphate and alkali-metal polyphosphates. As therein employed, such lubricant composition is reported suitable in hot forging processes and other metal forming operations such as drawing, press forming, extrusion, wire drawing and like processes where workpiece temperatures generally reach at least about 1100°–1300° F. for aluminum pieces and 1300° F.–2300° F. (generally 1800°–2000° F.) for steel workpieces. The average die temperature is reported to be about 600° F. with die temperatures varying from about 250° F. to 900° F. A reported test for hot drawing of steel artillery shell casings supplied such lubricant to the preheated punch or ram members over a time period varying between eight to eleven seconds with said time period said to be less than a twenty second spray period previously required with another prior art lubricant.

Various solid lubricants have also been employed as powders or particulates during the formation of metal workpieces at the aforementioned elevated work temperatures. A glass powder for such use is disclosed in U.S. Pat. No. 4,788,842 when forging ferrous alloy billets at working temperatures between about 800° C. and 1200° C. The solid lubricant is said to be removed from the finished article by sand blasting to produce a near metallic finish. In conducting the reported metal forming operation, such glass lubricant is applied as a coating to the preheated workpiece with the coated workpiece thereafter being forged. A different powdered lubricant is disclosed in U.S. Pat. No. 5,081,858 for the forging of hard to work metals such as stainless steel. The reported lubricant particles are electrically charged with high voltage for deposition on the preheated metal workpiece with the coated workpiece thereafter being found suitable for use in both cold and hot forging operations. Listed powdered lubricants include phosphoric acid, zinc calcium phosphate, metallic soap and oxalates.

It is also well known to lubricate various type mechanical systems operating at elevated temperatures with load bearing surfaces in dynamic physical contact, such as journal bearings, piston rings, gears, cams and the like. As the operating temperatures for these systems reach 300° C. and higher so as to even approach the melting points of conventional metals now being employed, it has become essential that more effective lubrication be provided. A recently developed lubrication means for ceramic bearing surfaces is disclosed in U.S. Pat. No. 5,139,876. As therein described, formation of a tenacious lubricating film is achieved upon treating the uncoated ceramic bearing surfaces at elevated temperatures with activating metal ions to form a deposit of the activating metal ions on the ceramic surface and thereafter exposing the treated ceramic surface to a vaporized polymer-forming organic reactant at elevated temperatures whereby an adherent solid organic polymer lubricating film is produced on the treated surface. Bearing surfaces formed with crystalline ceramic materials such as silicon nitride and silicon carbide as well as vitreous ceramics such as fused quartz can be provided with a protective coating resistant to dynamic wear conditions up to at least 500° C. and higher in this manner. In one embodiment, activated metal ions comprising a transition metal element is selected from the Periodic Table of Elements, to include iron and tin are initially deposited at temperatures of at least 300° C. on the ceramic surface. Formation of a lubricating film on the treated ceramic surface is achieved with vapor deposition again being conducted at elevated temperatures of approximately 300° C.–800° C. with various polymer forming organic reactants such as petroleum hydrocarbon compounds, mineral oils, various synthetic lubricants and to further include tricresyl phosphate (TCP) and triphenyl phosphate. Similarly, a copending application Ser. No. 07/937,425 entitled "High Temperature Lubrication For Metal and Ceramic Bearings", filed Aug. 31, 1992, in the names of Edgar Earl Graham and Nelson H. Foster, now U.S. Pat. No. 5,351,786, describes lubrication means provided with still other novel organic polymer lubricants formed in situ. In said method of lubrication, both metal and ceramic bearing surfaces undergo reduction of the friction coefficient and surface wear when provided with a novel class of phosphazene polymer lubricants vapor-deposited during atmospheric bearing operation at elevated temperatures of at least 300° C. During such operation the phosphazene starting compound becomes initially vaporized then polymerized in the vapor phase for subsequent deposition of the polymer product in lubricating amounts on at least one of the moving bearing surfaces. Suitable precursor reactants for such lubrication means include linear phosphazene, cyclophosphazene and cyclotetraphosphazene, including mixtures thereof, with a preferred reactant containing bis(4-fluorophenoxy)-tetrabis(3-trifluoromethylphenoxy) cyclotriphosphazene.

In a still more recently filed copending Ser. No. 08/109,949 application, filed Aug. 23, 1993 in the name of the present applicant and entitled "Elevated Temperature Metal Forming Lubrication", there is disclosed novel lubrication means when forming a preheated metal workpiece with a forming die at forming temperatures of at least 250° C. The disclosed lubrication means polymerizes a vaporizable and polymerizable organic reactant selected from the group consisting of phosphate esters and phosphazene compounds to form a solid polymer lubricant in situ when contacting the forming die with the preheated workpiece. A water-based suspension containing such organic reactant can be applied to the shaping region of the forming die as well as further applied to the preheated metal workpiece in carrying out the disclosed lubrication means. Evaluation tests reported in FIG. 2 of said copending application demonstrate an average five percent reduction in applied pressure during the hot forging of a steel workpiece with the disclosed lubrication means as compared with employment of a conventional graphite lubricant. In the disclosed evaluation, a water-based graphite lubricant containing about sixteen percent by volume graphite was compared with an aqueous emulsion formed by adding ten percent by volume ethanol and 0.5% by volume Durad 620B to water. The Durad 620B precursor lubricant is a commercially available tertiary-butylphenyl phosphate ester supplied by FMC Corporation under said trade name.

It is one object of the present invention, therefore, to provide a still further improved method for lubrication of metal workpieces being formed at elevated working temperatures which is less subject to the cost and shortcomings now being experienced with conventional lubrication means.

It is another object of the present invention to provide novel lubrication employing polymer lubricants in combination with graphite particulates for use in various metal forming operations at elevated temperatures.

It is a still further object of the present invention to provide a novel method for lubrication of metal workpieces being formed at elevated temperatures which employs relatively low lubricant levels.

These and further objects of the present invention will become apparent upon considering the following detailed description of the present invention.

SUMMARY OF THE INVENTION

It has now been found, surprisingly, that still more effective and efficient lubrication is provided with a small but effective amount of graphite lubricant being incorporated into the water-based starting lubricant disclosed in the aforementioned copending Ser. No. 08/109,949 application. More particularly, an addition of approximately 0.5 percent by volume graphite particulates in the therein disclosed aqueous emulsion containing said Durad 620B precursor lubricant enables significantly lower applied pressures to be employed when carrying out the forming of metal workpieces in otherwise the same manner. While graphite is an already recognized lubricant in various hot forging process, that its effect in combination with the phosphate ester is to still further lower applied pressures far below that previously experienced was simply not expected. Such combined lubrication means further enables considerably more satisfactory workpieces to be formed than was produced with Durad 620B lubrication alone at much higher applied pressures.

Accordingly, the essential steps in the presently improved method thereby requires (a) contacting the shaping region of the forming die with a liquid mist of a lubricant preparation containing a vaporizable and polymerizable organic reactant selected from the group consisting of phosphate esters and phosphazene compounds in combination with graphite particulates, (b) polymerizing the organic reactant in the applied lubricant preparation to form a solid polymer lubricant in situ, (c) forming the preheated metal workpiece with the lubricated forming die, and (d) removing the formed workpiece from the lubricated forming die. In one representative embodiment, the combined lubrication means of the present invention can be prepared for application as a simple physical admixture having the essential organic reactant and graphite particulates suspended together in an aqueous medium. Since the water-based emulsions disclosed in the previously identified copending Ser. No. 08/109,949 application can be employed for preparation of the present lubricant combination, the entire content of said application is hereby specifically incorporated by reference into the present application. For example, simply adding an aqueous colloidal graphite suspension to the previously disclosed water-based emulsions already having a suitable organic reactant suspended therein provides a satisfactory starting lubricant combination for use in accordance with the present invention. Application of the selected starting lubricant combination in accordance with the present invention can be carried out prior to conducting the actual metal forming operation as well as during an otherwise conventional metal forming process of this type. Thus already known manufacturing procedures which forge steel, titanium and nickel products from the heated billets in a continuous manner can be further improved with employment of the present lubrication means. The present lubricant combination can also be applied to a wide variety of forming dies including single die members having an internal cavity wherein the preheated metal workpiece is formed as well as multiple cavity die members and multi-part die constructions. Similarly the present lubricant combination can be applied to the die construction alone am well as applied to both heated metal workpiece and die construction while further having said die construction also being maintained at a sufficiently elevated temperature to remove liquid from the applied starting lubricant combination.

In a representative hot forging operation employing such combined means of lubrication with a ferrous alloy workpiece heated to at least 800° C. in a ferrous alloy forging die heated to around 150° C., the present method employs the steps of (a) exposing both workpiece and internal cavity of the forging die under atmospheric conditions and while heated at the specified elevated temperatures to a liquid mist formed with the present lubricant combination which includes a vaporizable and polymerizable aromatic phosphate compound and an organic liquid solvent therefor, (b) polymerizing the aromatic phosphate compound in the vapor-phase while in contact with the heated workpiece and the heated internal cavity of the forging die to form a vapor-deposited polymer lubricant on the contacted surfaces, (c) forging the lubricated workpiece in the lubricated forging die, and (d) removing the forged workpiece from the forging die. For other preferred embodiments employing aromatic phosphate compounds which are already liquid at ambient conditions such as tricresyl phosphate and triphenyl phosphate, the organic solvent can be eliminated from the present starting lubricant composition.

Representative phosphate esters found useful in the present lubrication method include triaryl phosphate esters such as tricresyl phosphate and triphenyl phosphate, mixed cresyl-xylenyl phosphates and cresyl-diphenyl phosphates. Correspondingly, the suitable phosphazene compounds include linear phosphazene, cyclophosphazene and cyclotetraphosphazene, with a preferred commercial product being available from the Dow Chemical Company as X-1P containing bis(4-fluorophenoxy)-tetrabis(3-trifluoromethylphenoxy) cyclotriphosphazene. A suitable graphite material for direct use in the present starting lubricant combination is finely divided colloidal graphite which is commercially available from numerous suppliers generally as a thick aqueous slurry containing from 10–20 volume percent of the graphite particulates.

DETAILED DESCRIPTION OF THE PREFERRED EMBODIMENTS

Figure 1:
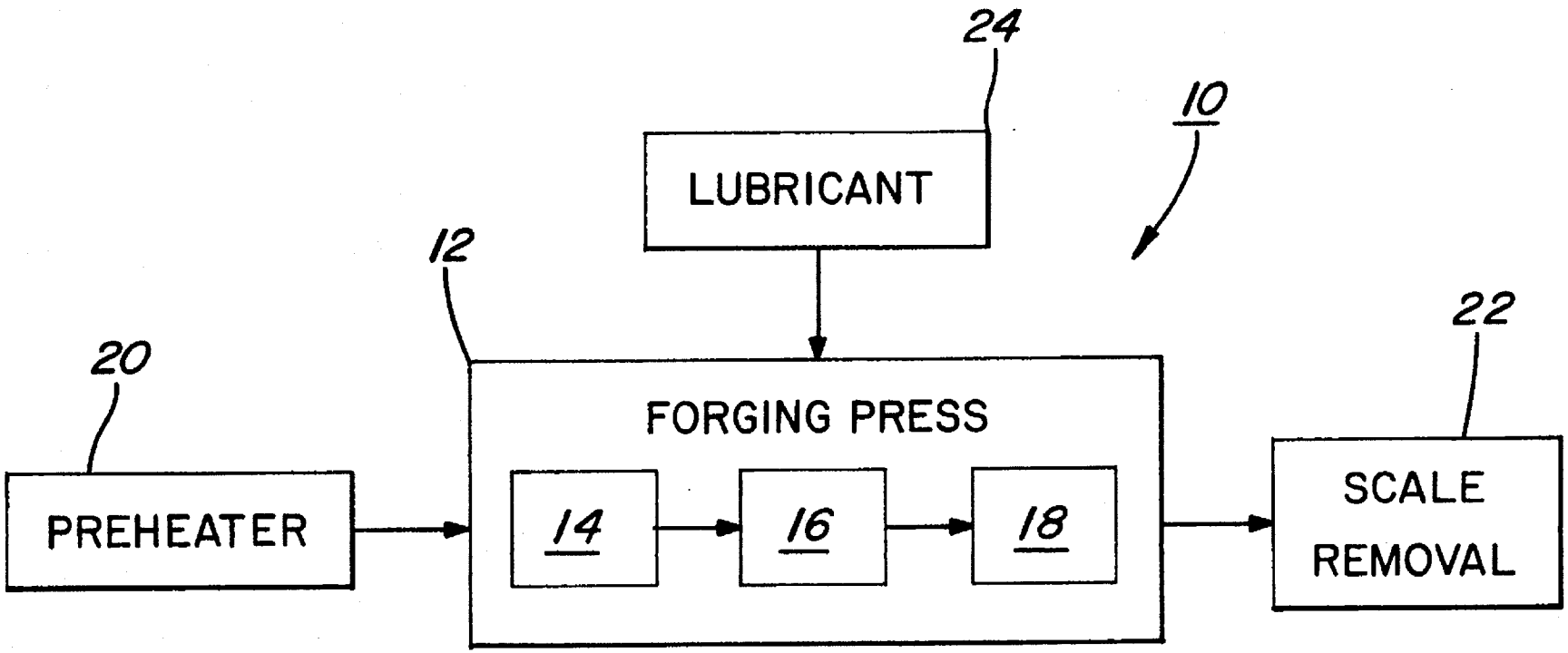
FIG. 1 is a block diagram illustrating representative forging equipment employed to conduct metal forming according to the present invention.

There is depicted in FIG. 1, a block diagram representing typical hot forging equipment 10 which can be employed to form the organic polymer lubrication means of the present invention. Said conventional press apparatus 10 utilizes a commercially available 1300 ton press 12 sold by the Viking Forge Corporation, Streetsboro, Ohio in combination with three sets of fixed and movable die members 14, 16 and 18 being employed in a sequential manner. In customary practice, a steel workpiece is first preheated by induction heater 20 to about 2000° F. and transferred to the cooperating fixed and movable heated die members (not shown) in die set 14 for an initial forming step taking place with about 200 tons of applied pressure. Said workpiece is then immediately transferred to the cooperating die members of intermediate die set 16 where principal forming of the workpiece takes place at elevated working temperatures often exceeding 250° F. while applied pressures reach 1400 tons and greater. A final finishing step in forming the still heated workpiece to the desired shape and size is formed in die set 18 at applied pressures of about 1000 tons. Any surface scale formed during said forging process is thereafter generally removed from the finished article with shot-blasting or similar means 22. Heretofore, the die cavities (not shown) in all three die sets were flooded prior to the forging steps with a water-based lubricant 24 containing about sixteen percent by volume of graphite lubricant at a rate of about fifty-five gallons of said prior art lubricant being employed to forge 1045 steel workpieces during an eight hour work period in die sets constructed with H13 steel alloy. Such conventional lubrication means for steel forging has produced some undesirable sticking of the steel workpiece in the forming die cavities leading to premature failure of the die sets through rapid wear and destruction. An additional problem encountered with employment of said conventional lubrication means in the illustrated forging embodiment is believed again due to insufficient lubrication being provided at elevated working temperatures varying between 250° F. up to 900° F. which produced higher than desirable applied pressures being required during the intermediate forming step in excess of 1400 tons applied pressure.

In contrast thereto, much superior die lubrication is experienced in the above illustrated embodiment upon substituting the organic polymer lubricants disclosed in the copending Ser. No. 08/109,949 application. Comparative test results reported in said copending application demonstrated a five percent reduction in applied pressure being achieved with a starting lubricant emulsion formed upon adding ten percent by volume ethanol and 0.5 percent of a commercial aromatic phosphate compound (Durard 620B) to water. For a test evaluation of the present lubrication means, still further comparative tests were conducted in the same manner employing a starting lubricant which now added a small but effective amount of graphite particulates to the previously tested phosphate containing emulsion. Specifically, said previously tested emulsion was modified to further include 0.5 volume percent colloidal graphite and 0.5 volume percent of a commercial surfactant (ICI Tween 80). The particular graphite material that was employed was obtained from the Rite Lube Corporation as a seventeen percent aqueous slurry.

Figure 2:
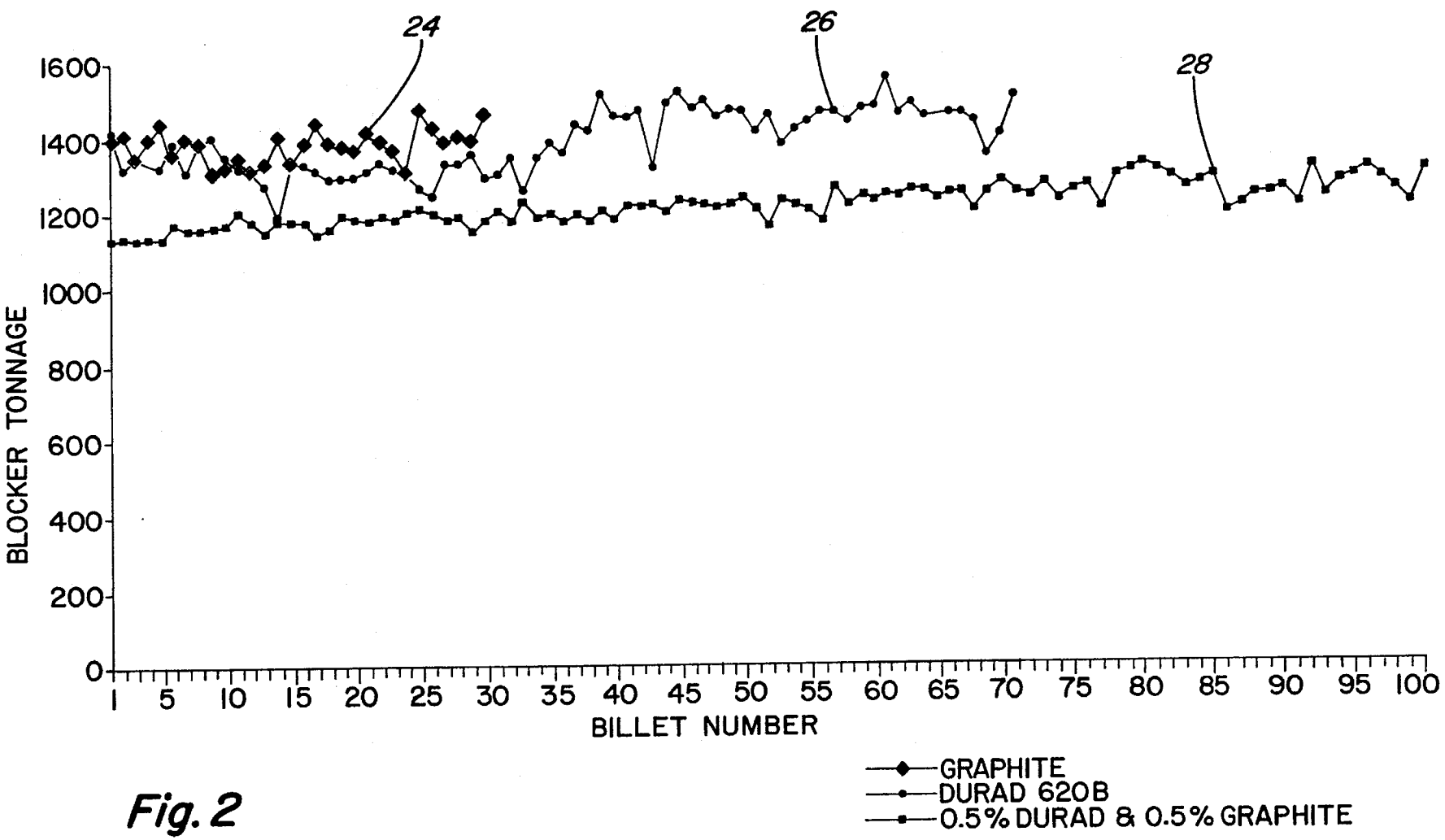
FIG. 2 is a graph enabling comparison to be made between lubrication provided with prior art graphite and phosphate esters lubricants and that afforded in accordance with the present invention.

A graph depicting the applied pressure for intermediate die set 16 in the above illustrated forging embodiment when different lubrication means are employed is shown in FIG. 2. Plot 24 lists applied pressure values measured for a successive number of steel workpieces being processed with conventional graphite lubrication. Plot 26 provides the same measurements for said workpieces with lubrication being provided by the above illustrated phosphate containing emulsion devoid of graphite particulates. The measured applied pressure values for successive workpieces being lubricated with said above illustrated phosphate emulsion which now includes graphite are depicted in Plot 28 of said graph. As can be seen from said comparison, the later lubrication means in accordance with the present invention demonstrates a significant reduction in the applied pressure needed for production of a satisfactory forged product and continues to do so for a far greater number of workpieces than realized with the other lubricants. A still further benefit noted in conducting said evaluation is the absence of adherent graphite particles on the forged articles when employing the lubrication means of the present invention whereas articles lubricated with the conventional graphite lubrication required considerable graphite removal.

It will be apparent from the foregoing description that broadly useful and novel means have been provided to continuously lubricate metal workpieces being formed at elevated working temperatures of at least 250° C. It is contemplated that the present lubrication method can be applied to a broad range of metal forming processes other than that above illustrated, however, to include drawing, extrusion, wire drawing and still other elevated temperature metal working processes. Likewise, it is contemplated that the liquid lubricant compositions being applied in the present method of lubrication can be further modified for improved performance to include possible incorporation of additional graphite for lubrication as well as adding still other ingredients to the disclosed emulsions for increased stability during storage and use. Consequently it is intended to limit the present invention only by the scope of the appended claims.

What I claim as new and desire to secure under Letters Patent of the United States is:

1. A method of forging a metal workpiece preheated to at least 800° C. with a metal forging die at forming temperatures of at least 250° C. which comprises the steps of:

(a) contacting the shaping region of the forging die with an aqueous mist of a lubricant preparation containing at least 0.5 percent by volume of a vaporizable and polymerizable organic reactant selected from the group consisting of phosphate esters and phosphazene compounds in combination with graphite particulates, (b) vaporizing the applied organic reactant at the elevated forming temperatures, (c) polymerizing the vaporized organic reactant in the vapor phase upon further contacting the shaping region of the forging die with the preheated workpiece to form a solid polymer lubricant in the shaping region of the forging die, (d) forming the preheated metal workpiece in the lubricated forging die, and (e) removing the formed workpiece from the forging die.

2. The method of claim 1 wherein forming of the workpiece is carried out under atmospheric conditions.

3. The method of claim 1 wherein the metal workpiece is a ferrous alloy.

4. The method of claim 1 wherein both forming die and preheated metal workpiece is contacted with the lubricant.

5. The method of claim 1 wherein the forging die is also maintained at sufficiently elevated temperature to remove water from the applied lubricant.

6. The method of claim 1 wherein the organic reactant is an aromatic phosphate compound.

7. The method of claim 1 wherein the organic reactant is an aromatic phosphazene compound.

8. The method of claim 1 wherein the lubricant comprises a water-based emulsion.

9. The method of claim 8 wherein the lubricant includes an organic liquid solvent.

10. The method of claim 8 wherein the lubricant includes an aromatic phosphate compound emulsified with an organic liquid solvent in water.

11. The method of claim 1 wherein the forging die includes a pair of cooperating die members.

12. The method of claim 11 wherein the cooperating die members comprise a fixed member and a movable member.

13. A method of hot forging a ferrous alloy workpiece preheated to at least 800° C. in a ferrous alloy forging die heated to about 150° C. which comprises the steps of:

(a) contacting the shaping region of the forging die under atmospheric conditions and while heated at the specified elevated temperature to an aqueous mist formed with a water-based emulsion containing at least 0.5 percent by volume of a vaporizable and polymerizable aromatic phosphate compound and graphite particulates, (b) vaporizing the applied aromatic phosphate compound at the elevated forging die temperature, (c) polymerizing the applied aromatic phosphate compound in the vapor-phase upon further contacting the shaping region of the forging die with the preheated workpiece to form a solid polymer lubricant in the shaping region of the forging die, (d) forging the preheated workpiece in the lubricated forging die, and (e) removing the forged workpiece from the forging die.

14. A lubricated metal forging die made by:

(a) preheating a metal workpiece to an elevated temperature of at least 800° C., (b) transferring the preheated workpiece to the shaping region of a metal forging die, (c) concurrently contacting the shaping region of the metal forging die with an aqueous mist containing at least 0.5 percent by volume of a voporizable and polymerizable organic reactant selected from the group consisting of phosphate esters and phosphazene compounds in combination with graphite particulates, (d) vaporizing the organic reactant while in contact with the preheated workpiece and metal forging die, (e) polymerizing the vaporized organic reactant in the vapor-phase while in contact with the preheated workpiece and metal forging die to form a solid polymer lubricant in situ, and (f) depositing the solid polymer lubricant as a film on the contacted shaping region of the metal forging die.

15. The lubricated metal forging die of claim 14 wherein the aqueous mist comprises a water-based emulsion.

* * * * *